US005287598A

United States Patent [19]

Günter et al.

[11] Patent Number: 5,287,598

[45] Date of Patent: Feb. 22, 1994

[54] SLIVER CHANNEL

[75] Inventors: Mahrt Günter; Oexler Rudolf, both of Ingolstadt, Fed. Rep. of Germany

[73] Assignee: Rieter Ingolstadt Spinnereimaschinenbau AG, Ingolstadt, Fed. Rep. of Germany

[21] Appl. No.: 984,997

[22] Filed: Dec. 2, 1992

[30] Foreign Application Priority Data

Dec. 4, 1991 [DE] Fed. Rep. of Germany ..... 4139910

[51] Int. Cl.[5] ..... D04H 11/00

[52] U.S. Cl. ..... 19/159 R

[58] Field of Search ..... 19/157, 159 R, 159 A

[56] References Cited

U.S. PATENT DOCUMENTS

| | | | |
|---|---|---|---|
| 3,105,996 | 10/1963 | Naegeli | 19/159 R |
| 3,141,201 | 7/1964 | Gasser | 19/159 R |
| 4,223,422 | 9/1980 | Weber . | |
| 4,318,206 | 3/1982 | Ferri et al. . | |
| 4,646,390 | 3/1987 | Bothner . | |
| 4,691,414 | 9/1987 | Kluttermann | 19/159 R |
| 4,905,352 | 3/1990 | Gunkinger et al. . | |

FOREIGN PATENT DOCUMENTS

| | | | |
|---|---|---|---|
| 212195 | 4/1960 | Austria | 19/159 R |
| 0376228A2 | 7/1990 | European Pat. Off. . | |
| 1115622 | 10/1961 | Fed. Rep. of Germany . | |
| 1115623 | 10/1961 | Fed. Rep. of Germany | 19/159 R |
| 1167707 | 4/1964 | Fed. Rep. of Germany . | |
| 1209030 | 1/1966 | Fed. Rep. of Germany . | |
| 1510310 | 2/1970 | Fed. Rep. of Germany . | |
| 2406225 | 8/1974 | Fed. Rep. of Germany . | |
| 2540148 | 3/1977 | Fed. Rep. of Germany . | |
| 142428 | 6/1980 | Fed. Rep. of Germany . | |
| 2923917 | 12/1980 | Fed. Rep. of Germany . | |
| 3118968 | 12/1982 | Fed. Rep. of Germany . | |
| 3246420A1 | 6/1984 | Fed. Rep. of Germany . | |
| 3407135 | 8/1985 | Fed. Rep. of Germany . | |
| 3819981A1 | 12/1989 | Fed. Rep. of Germany . | |
| 272159 | 8/1964 | Netherlands . | |
| 1527119A1 | 12/1989 | U.S.S.R. . | |
| 15640921A | 5/1990 | U.S.S.R. . | |

*Primary Examiner*—Clifford D. Crowder
*Assistant Examiner*—Michael A. Neas
*Attorney, Agent, or Firm*—Dority & Manning

[57] ABSTRACT

The invention relates to a sliver channel of a spinning plant preparation machine for the deposit of a fiber sliver in a container. The sliver channel is designed in form of a helix with changing gradient.

6 Claims, 3 Drawing Sheets

SLIVER CHANNEL

BACKGROUND OF THE INVENTION

The present invention relates to a sliver channel of a spinning plant preparation machine for depositing a fiber sliver in a container.

A sliver channel located in the rotary plate of a spinning plant preparation machine the central line of which is a helix, is known from DE-AS 11 15 622. The helix has a constant gradient and curvature. The cross-section of the sliver channel is circular and tapers downward. The disadvantage with the known sliver channel is that when it is used in modern spinning plant preparation machines, in particular in drawing frames with delivery speeds of over 800 m/min, the fiber sliver which had been given a uniform character with utmost precision cannot be deposited in the container with sufficient care. At these high speeds it has also been shown that the hairiness of the fiber sliver increases as it is being deposited, and this is detrimental to fiber sliver quality.

OBJECTS AND SUMMARY OF THE INVENTION

It is therefore a principle object of the instant invention to ensure a highly regular deposit of fiber slivers that is not damaging to the fibers in the container, especially in a rapid spinning plant preparation machine, through appropriate configuration of the sliver channel.

Additional objects and advantages of the invention will be set forth in part in the description which follows, and in part will be obvious from the description, or may be learned by practice of the invention.

The objects are achieved through a sliver channel made in the form of a helix with changing gradient so that regular and non-damaging deposit of the fiber sliver in the container is achieved. The gradient is advantageously designed so that the forces acting upon the fiber sliver due to the movement of the channel sides of the sliver channel may be as insignificant and uniform as possible. The sliver channel has a constant gradient in the direction of its outlet end. This end of the sliver channel therefore corresponds to a conventional helix. Contrary to the state of the art, the present sliver channel prevents the fiber sliver from being introduced immediately into a helix with constant gradient but, first introduces the fiber sliver without deflection into the sliver channel to be then gradually deflected up to the constant gradient of the sliver channel. A depositing angle from 10° to 20° at which the fiber sliver emerges from the sliver channel and is guided into the container has been proven to be especially advantageous.

The decreasing gradient at the beginning of the sliver channel is designed advantageously as an arc of a circle. The location of the arc at the beginning of the sliver channel is especially advantageous if the tangent on the sliver channel is vertical, i.e. if the gradient is infinite.

If the sliver channel is designed so that it is equal to a semi-circle in top view, such advantageously causes gradual acceleration of the fiber sliver. As a result the force being transferred from the rotating sliver channel on the fiber sliver is kept to a minimum.

The accompanying drawings constitute a part of the specification and illustrate embodiments of the invention and, together with the description, serve to explain principles of the invention. Elements of one embodiment of the figures are interchangeable in other embodiments, as are elements having like designations, so long as the combination of elements is covered by the appended claims.

To achieve a more even guidance and less costly fabrication of the sliver channel it is advantageous for the sliver channel to have a constant circular cross-section.

DESCRIPTION OF THE PREFERRED EMBODIMENTS

Reference will now be made in detail to the presently preferred embodiments of the invention. Each example is provided by way of explanation of the invention, not limitation of the invention. It will be apparent to those skilled in the art that various modifications can be made in the invention without departing from the scope or spirit of the invention, and it is intended that the present invention cover such modifications as come within the scope of the claims and their equivalents.

Figure 1:
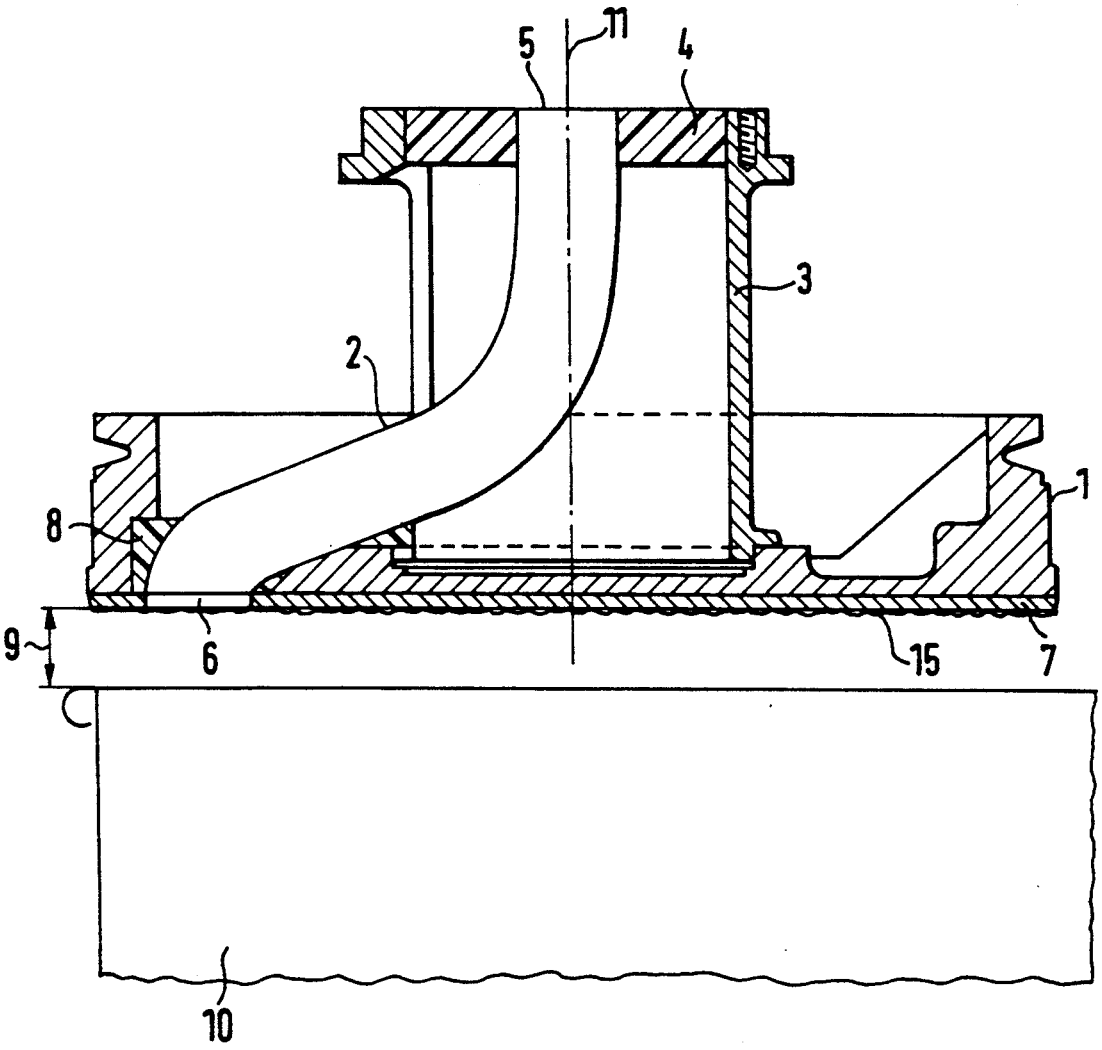
FIG. 1 shows a longitudinal cross-sectional view of a rotary plate and a spinning can.

FIG. 1 shows a sectional view through a rotary plate 1 with a sliver channel 2 according to the invention. The rotary plate is installed in a spinning plant preparation machine, e.g. in a drawing frame or carding machine.

The fiber sliver enters the sliver channel 2 at inlet 5, goes through said sliver channel 2 and then emerges again from the sliver channel 2 in outlet 6. The sliver channel 2 is centered in the rotary plate 1. The rotary plate 1 rotates around a rotational axis 11 during the depositing of the fiber sliver.

The rotation of the rotary plate 1 about rotational axis 11 causes the fiber sliver to be deposited in a circular pattern in can 10. Can 10 rotates at the same time the fiber sliver is deposited in cycloid form so that the can 10 may be filled in a more uniform manner and more completely with the fiber sliver.

A cast mass 4 connects the sliver channel 2 to a plate holder 3. This ensures that the sliver channel 2 is always positioned correctly and does not change its position under outside influences. The sliver channel 2 is also fixed at its outlet 6 by means of a cast mass 8. The cast mass 8 ensures a transition without gaps between the sliver channel 2 and the rotary plate i at the underside of said rotary plate.

The underside of the rotary plate is provided with a cover 7. The cover 7 is made of a material, preferably special steel, producing minimum friction on the fiber sliver. In addition to providing for extremely low friction this also ensures that the cover 7 or the rotary plate 1 will be less subject to wear. In addition, costly machining of the bottom of the rotary plate, in particular grinding and priming of the underside of the rotary plate, is avoided. Also, less care need be taken when casting the sliver channel 2 with the cast mass into the rotary plate since the sprue point is enclosed in such manner by the cover 7 that only the free cross-section of the sliver channel 2 is free.

Especially when processing synthetic fibers, the utilization of a surface 15 of the cover 7 with shallow structure on the side of the spinning can 10 has proven to be advantageous. An orange skin texture or scarred-leather type structure in particular prevents an adhesion-by-suction effect of the fibers of the deposited fiber sliver against the cover. Non-destructive deposit of the fiber sliver is thus ensured.

Depending on which spinning can 10 of the fiber sliver depositing device is placed under the rotary plate 1, the distance 9 between the underside of the rotary plate 1 or the cover 7 and the upper edge of the spinning can 10 will be more or less great. Due to the configuration of the sliver channel 2, the fiber sliver is deposited in the spinning can 10 without any major radial velocity component. Because of the almost complete absence of a velocity component the device according to the instant invention advantageously prevents a fiber sliver from being thrown over the edge of the spinning can. In this way especially uniform and orderly depositing of the fiber sliver is ensured. Furthermore, the orderly deposit also ensures favorable draw-off of the fiber sliver from can 10. This is especially effective at high delivery speeds. The ejection of the fiber sliver from the can, especially as the first layers of the fiber sliver are being deposited, could be observed in the state of the art. With the sliver channel designed according to the invention the ejection of the fiber sliver is effectively avoided and, furthermore, an especially non-destructive deposit of the fiber sliver, without change in its condition from what it was at the inlet 5, is ensured.

Figure 2:
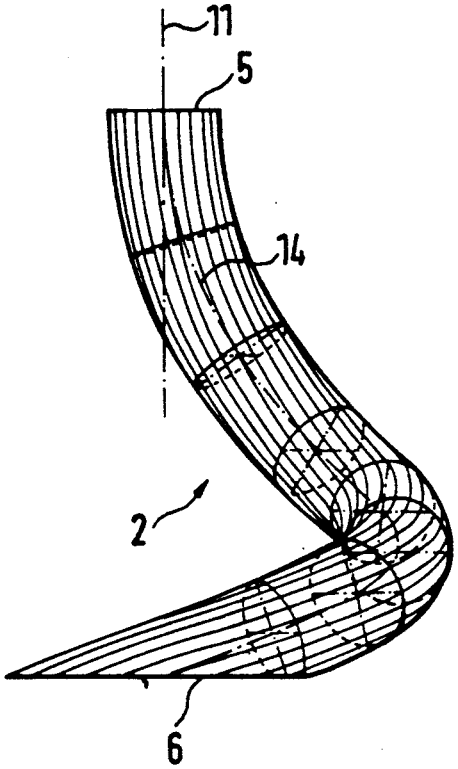
FIGS. 2 and 3 show a side view of a sliver channel.

FIG. 2 shows a side view of sliver channel 2. The sliver channel 2 has a center line 14 which extends in helical form. The helix of the center line 14 has a changing gradient. At the inlet 5 of sliver channel 2 the gradient of the center line 14 is substantially infinite. The rotational axis 11 of the rotary plate 1 is tangent to the center line 14 at inlet 5. Friction-free introduction of the fiber sliver into the sliver channel 2 as it is being conveyed to said sliver channel 2 in the rotational axis 11 is thus ensured. The cross-section of sliver channel 2 remains circular and constant up to its outlet 6. The circular cross-section is distorted in the drawing of FIG. 2 and is therefore shown as an oval.

Figure 3:
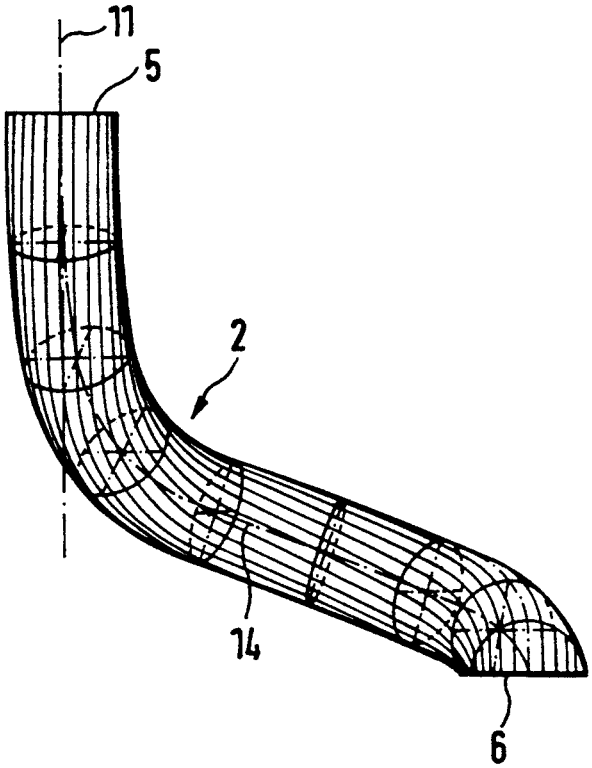

FIG. 3 shows another side view of the sliver channel 2. It can be seen in FIGS. 2, 3 and 4 that the sliver channel extends in the form of a helix. The helix first descends steadily as it starts out from inlet 5 and then goes into a constant ascending gradient until it ends at outlet 6. The plane of inlet 5 and the plane of outlet 6 are parallel. The sliver channel 2 is therefore cut off in such manner at outlet 6 that an opening in form of a distorted oval is produced.

Figure 4:
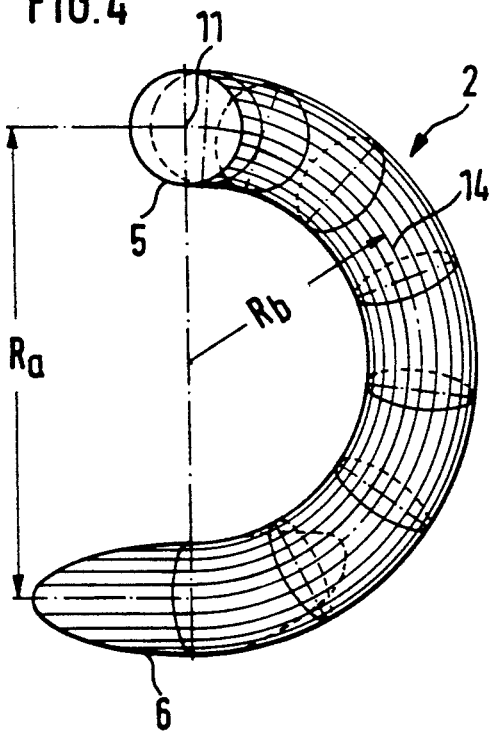
FIG. 4 shows a top view of a sliver channel.

FIG. 4 shows a top view of the sliver channel 2. The cross-section of the openings at inlet 5 and outlet 6 can be seen here. A round circular cross-section is obtained at the inlet 5 through the tangential passage of the center line 14 into the rotational axis 11 which is perpendicular to the plane of the drawing. This cross-section is identical with the cross-section of the entire sliver channel in relation to an orthogonal plane on center line 14. The helix of sliver channel 2 produces an arc radius $R_b$ which is equal to one half of the depositing radius $R_a$ of the sliver channel. The fiber sliver is deposited in accordance with a depositing radius $R_a$ in a diameter equal to twice the value of the depositing radius $R_a$. The actual deposit of the fiber sliver may in some cases be somewhat larger than two times $R_a$ if the fiber sliver has a clearly smaller diameter than the cross-section of the sliver channel 2 and is therefore pressed closer to the outer or to the inner side of the sliver channel, depending on depositing speed, as the sliver is being deposited.

Figure 5:
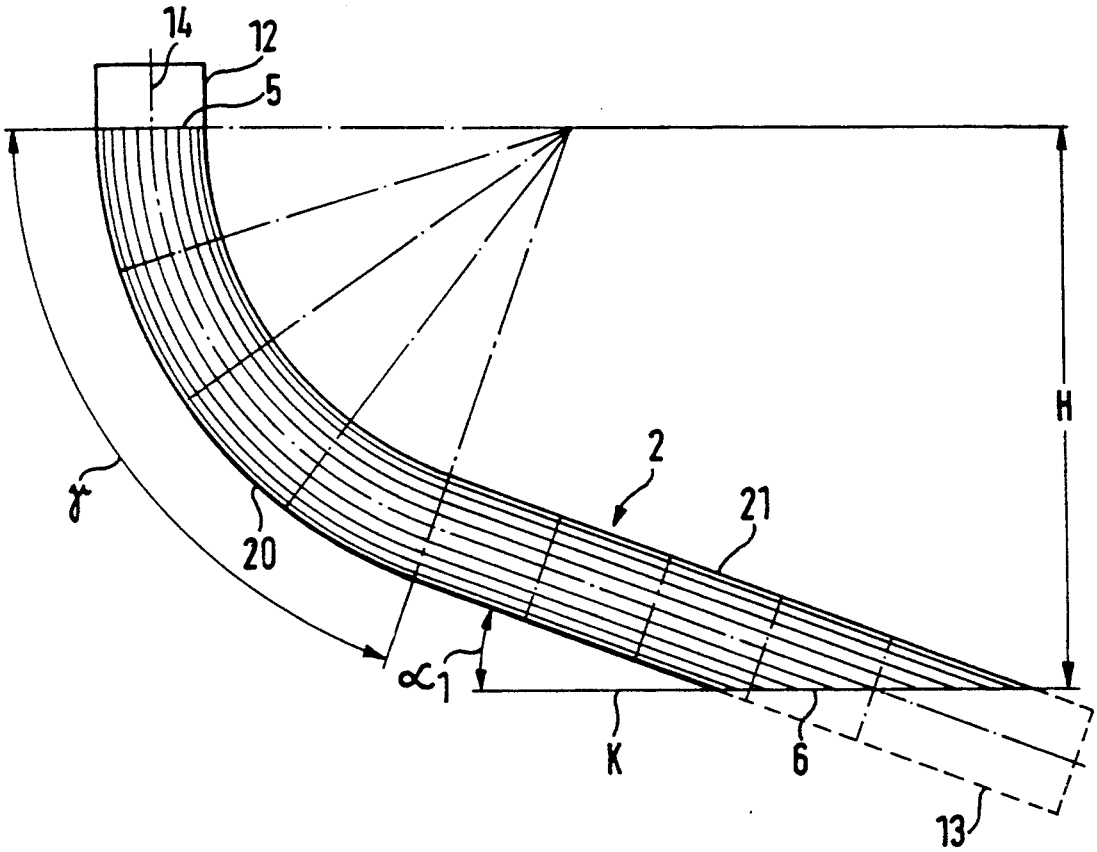
FIG. 5 shows the developed view of a sliver channel from the side.

FIG. 5 shows the developed view of a sliver channel 2. This means that the sliver channel is bent into a straight line in a plane so that the cross-sections of the sliver channel 2 are always represented as lines in the side view of FIG. 5. In this drawing the changing gradient of the sliver channel can be clearly seen. The center line 14 extends in this embodiment from inlet 5 at first in an arc of circle 20 and then becomes a straight line 21 sloping downwards until it has reached the outlet of the sliver channel 2. This means that the gradient of the sliver channel 2, starting at the inlet 5, becomes increasingly flat in the first section of the sliver channel 2 and then remains constant after a certain point. The straight developed view of the center line 14 represents a conventional helix with constant gradient. The changing gradient of the helix is shown in the arc of circle 20. Other changes in the gradient, aside from this arc of circle 20, are also possible. The arc of circle has however proven to be the most advantageous as its design is the most non-destructive to the fiber sliver. The gradient arc 20 extends in this embodiment over an arc angle $\mu$ of approximately 70°. The gradient arc 20 is followed by a gradient 21 in a straight line. The size of the arc angle $\mu$ influences the height or the depositing radius $R_a$ of the sliver channel 2. The greater the arc angle $\mu$, the lower is the height H and the greater is the depositing radius $R_a$. Since the inlet 5 together with the beginning of arc angle $\mu$ is always in a plane parallel to plane K of the deposit in the can, the size of the arc angle $\mu$ also determines a depositing angle $\alpha_1$. A depositing angle between 10° and 20° has proven to be advantageous.

In FIG. 5 the straight lines 12 and 13 are provided before inlet 5 and after outlet 6. These straight lines serve in the fabrication of the sliver channel 2 by means of a bending process. The straight lines 12 and 13 are used here for easier handling of the sliver channel 2. After the bending process they are removed from the locations of inlet 5 and outlet 6.

Figure 6:
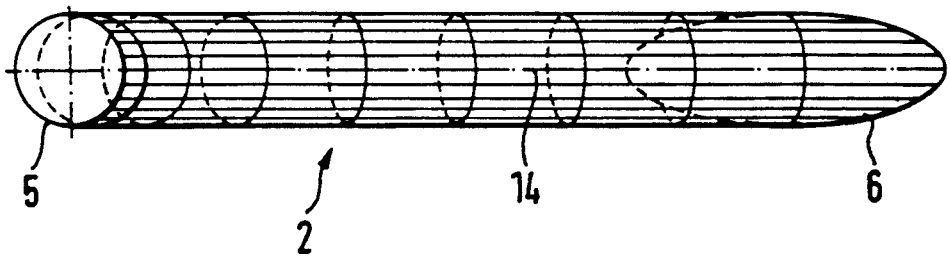
FIG. 6 shows the developed view of a sliver channel from above.

FIG. 6 shows a top view of the developed view of a sliver channel. The inlet 5 is shown to be circular in this embodiment, corresponding to the cross-section of the sliver channel 2. Outlet 6 has an oval opening which is formed by the intersection of the circular sliver channel 2 and plane K of deposit in the can at depositing angle $\alpha_1$. In the top view of FIG. 6 the center line 14 of the sliver channel 2 is shown to be a straight line. The cross-sections of the sliver channel 2 change from a circular form into an oval form as a result of the changing gradient of sliver channel 2.

The instant invention is not limited to the embodiment shown. The invention thus also covers an embodiment the developed view of which is not an arc of circle followed by a straight line but can have a changing gradient from inlet 5 to outlet 6. The invention also covers an embodiment in which a sliver channel segment with changing gradient is provided between two sliver channel segments with constant gradient.

We claim:

1. A sliver channel for use with a sliver preparation machine for depositing fiber sliver into a container, said sliver channel comprising:

an inlet having a substantially infinite gradient;

a first portion immediately adjacent said inlet, said first portion describing a predetermined arc angle and having an increasingly flattening gradient from the infinite gradient of said inlet;

a second portion immediately adjacent said first portion, said second portion comprising a helix having a constant gradient; and an outlet formed at the end of said second portion, said outlet being substantially parallel to a horizontal plane through said channel, said constant gradient of said second portion and said outlet forming a deposit angle with the horizontal plane within a predetermined range.

2. The sliver channel as in claim 1, wherein said predetermined arc angle of said first portion is approximately 70 degrees.

3. The sliver channel as in claim 1, wherein when viewed from the top thereof, said sliver channel defines substantially a semi-circle.

4. The sliver channel as in claim 1, wherein said outlet angle is within the range of generally 10 to 20 degrees.

5. The sliver channel as in claim 1, wherein said channel comprises a substantially constant circular cross-sectional profile along substantially the entire length thereof.

6. A sliver channel for use with a sliver preparation machine for depositing fiber sliver into a container, said sliver channel comprising:

a substantially constant circular cross-sectional profile along substantially the entire length thereof;

an inlet having a substantially infinite gradient;

a first portion immediately adjacent said inlet, said first portion describing a predetermined arc angle of approximately 70 degrees and having an increasingly flattening gradient from the infinite gradient of said inlet;

a second portion immediately adjacent said first portion, said second portion comprising a helix having a constant gradient; and an outlet formed at the end of said second portion, said outlet being substantially parallel to a horizontal plane through said channel and said inlet, said constant gradient of said second portion and said outlet forming a deposit angle with the horizontal plane within a range of approximately 10 to 20 degrees, said sliver channel defining substantially a semi-circle when viewed from the top thereof.

* * * * *